US005373988A

United States Patent [19]

Rao

[11] Patent Number: 5,373,988

[45] Date of Patent: Dec. 20, 1994

[54] RAIL FASTENING ASSEMBLY

[76] Inventor: Yellapragada S. Rao, H. No. 23/67/1, PLOT 44, Radhakrishna Nagar, Malkajgiri, Hyderabad - 500 047, India

[21] Appl. No.: 804,728

[22] Filed: Dec. 11, 1991

[51] Int. Cl.[5] ..... E01B 9/40

[52] U.S. Cl. ..... 238/349; 238/338

[58] Field of Search ..... 238/264, 265, 278, 338, 238/343, 345, 349, 310, 315, 341, 351

[56] References Cited

U.S. PATENT DOCUMENTS

| | | | |
|---|---|---|---|
| 3,749,310 | 7/1973 | Borup et al. | 238/349 |
| 4,067,495 | 1/1978 | Qureshi | 238/349 |
| 4,442,973 | 4/1984 | Fee | 238/349 |
| 4,600,145 | 7/1986 | Geddes | 238/310 X |
| 4,715,534 | 12/1987 | Fee | 238/349 |
| 4,770,343 | 9/1988 | Heim et al. | 238/351 X |
| 4,801,084 | 1/1989 | Rex | 238/351 |
| 5,069,386 | 12/1991 | Duval | 238/349 |
| 5,096,119 | 3/1992 | Schultheiss et al. | 238/349 |

OTHER PUBLICATIONS

Koppers, "DS-18 Double-Shank Elastic Rail Fastner", Oct. 12, 1982, p. FP-995.

Fist-BTR, "Rail Fastening System for Concrete Sleepers," Oct. 12, 1982, 6 page brochure.

*Primary Examiner*—Michael S. Huppert

*Assistant Examiner*—Scott L. Lowe

[57] ABSTRACT

A rail fastening assembly for fastening a rail to a sleeper and comprising an insert and a complimentary resilient clip. The insert has a shank portion extending upwardly into a jaw. The jaw has a locating recess extending along the entire length of the upper surface and with the depth for receiving the clip. The base of the jaw has a seat with a ledge extending into a projection. The clip comprises a first and second loops, each having a flat surface.

13 Claims, 3 Drawing Sheets

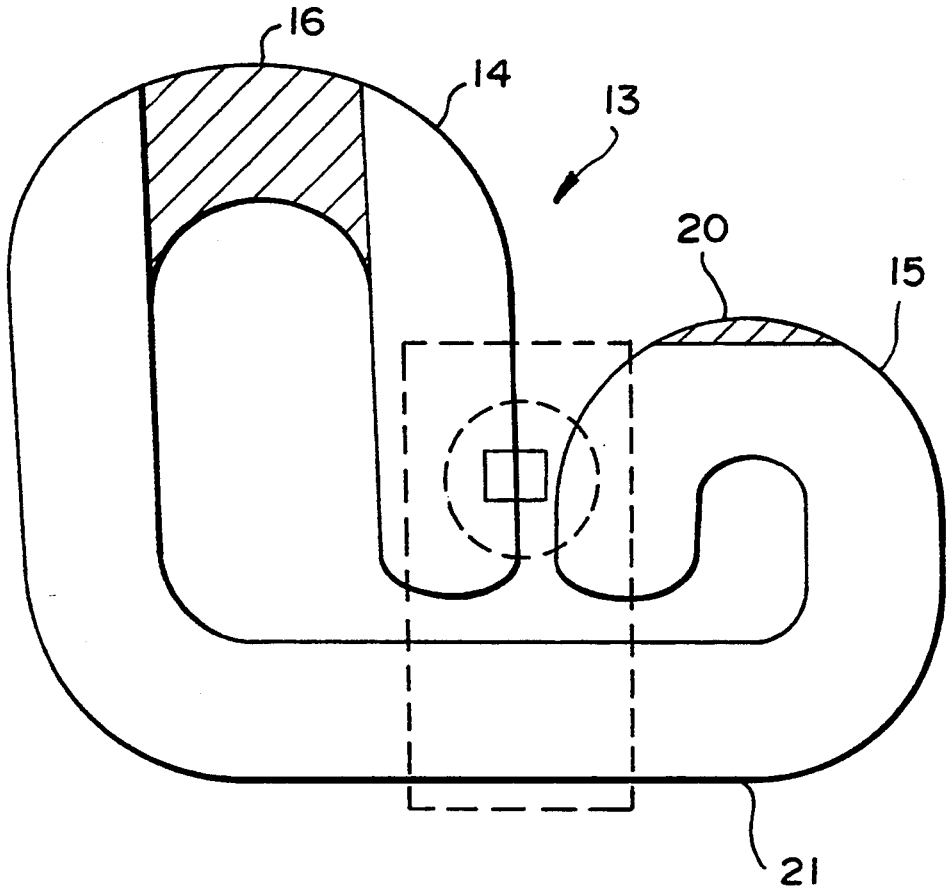
FIG. 4
FIG. 4A
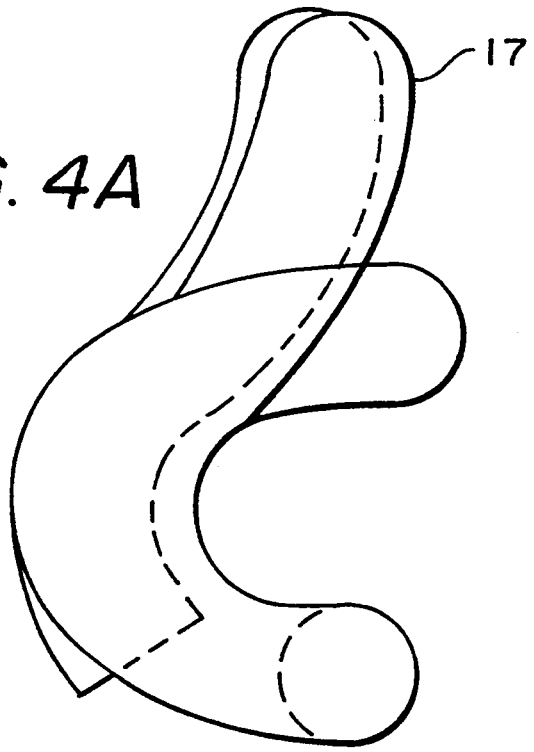

RAIL FASTENING ASSEMBLY

FIELD OF THE INVENTION

This invention relates to a rail fastening assembly of the type comprising an insert secured to a sleeper and a resilient clip.

PRIOR ART

An insert known in the art comprises a shank portion secured to a sleeper with a jaw member extending upwardly of said sleeper. The jaw member has a seat for supporting the horizontal arm of a complimentary resilient clip. The upper surface of the jaw has a locating recess for receiving a first loop of the resilient clip and a second sloping surface for receiving the second loop of said resilient clip.

A disadvantage associated with such a construction is that the rail fastening member could be subjected to sabotage in that the clip could be removed therefrom. Still further and in the event of a derailment, means were not provided for preventing a lateral displacement of the rail.

A resilient clip known in the art for use with an insert or a clamp and screw type assembly consists of a horizontal arm adapted to be held to the insert, said horizontal arm having a force acting in the upward direction due to reaction of the insert. One end of said horizontal arm extends into a toe member adapted to bear against the flange of the rail and such that the toe load from the clip acts on the rail flange. The toe member extends into a terminating or heel member adapted to be supported on the insert, and such that the heel and toe portion gives a downward force due to reaction of the insert.

In such a known construction, the elastic fastening or resilient clip was made of a spring metal bar and consisted of a preformed member and such that even when under stress the clip retained its original form. Thus, the horizontal member extends into an arch member and developed into a half completed loop member.

The main disadvantage associated with the clip known in art is that it is not pilfer or antisabotage proof. Another disadvantage is that the load distribution is only a point concentrated on the part of the clip which rests on the bottom rail flange. Yet another disadvantage of the known clip is that there is no provision for absorbing lateral forces exerted by bottom rail flange on the clip.

OBJECTS OF THE INVENTION

Accordingly, a primary object of this invention is to propose a modified and improved construction of a rail fastening assembly comprising an insert and a resilient clip.

Another object of this invention is to propose an insert for use in a rail fastening assembly and having means for preventing a lateral displacement of the rail.

BRIEF DESCRIPTION OF THE INVENTION

According to this invention, there is provided a rail fastening assembly comprising an insert and a resilient clip, said insert comprising a shank portion extending into a jaw, the base of said jaw having a seat, the upper surfaces of said jaw having a locating recess extending into a sloped surface, said seat having a ledge extending into a projection, said projection extending beyond said jaw.

The insert comprises a shank portion adapted to be disposed within the sleeper. Outwardly extending lugs are provided with said shank such as to prevent an unauthorized removal of the shank from the sleeper. The shank portion extends into a jaw, the base of said jaw having a seat in the form of channel and with a ledge. The upper surface of the jaw has a locating recess extending into guide means comprising an outwardly extending arcuate surface.

Specifically, in accordance with the present invention, the ledge extends into a projection extending beyond the jaw, but terminates away from the rail. Thus, in the event of a derailment, the projection limits or restricts the lateral displacement of the rail. In accordance with one embodiment, the projection is provided only across a part of the length of the ledge. Such an insert is used in conjunction with a resilient clip having one loop smaller than the other. In accordance with another embodiment, the projection is provided across the entire length of the ledge. Such an embodiment of the insert is used with a resilient clip having two equal loops, and when the projection is adapted to bear against the bottom rail flange.

Further, according to this invention the resilient clip is made of resilient metal bar and comprises a first loop adapted to bear on the rail flange for dampening of vertical vibrations and loads, a first loop extending into a second loop and means for securing said clip within an insert, said first loop having a flat portion to bear on the rail flange for proper distribution of the load and to reduce the stress concentration.

In accordance with one embodiment, the second loop bears against the flange laterally. In accordance with a second embodiment, the second loop also bears on the flange. In such an embodiment, a flat portion may be provided on the first and/or second loop.

In accordance with a further embodiment of this invention, the first loop has a raised portion, which when pressed is in the same level as the remaining portion of the loop. This provides a wedging action against longitudinal movements of rail, and thus resist the forces caused due to temperature variations or dynamic movement of the rail.

Further objects and advantages of this invention will be more apparent from the ensuing description when read in conjunction with the accompanying drawings and wherein:

DESCRIPTION OF THE INVENTION WITH REFERENCE TO THE ACCOMPANYING DRAWINGS

FIGS. 4 & 4A show the clip in accordance with one embodiment of this invention;

Figure 1:
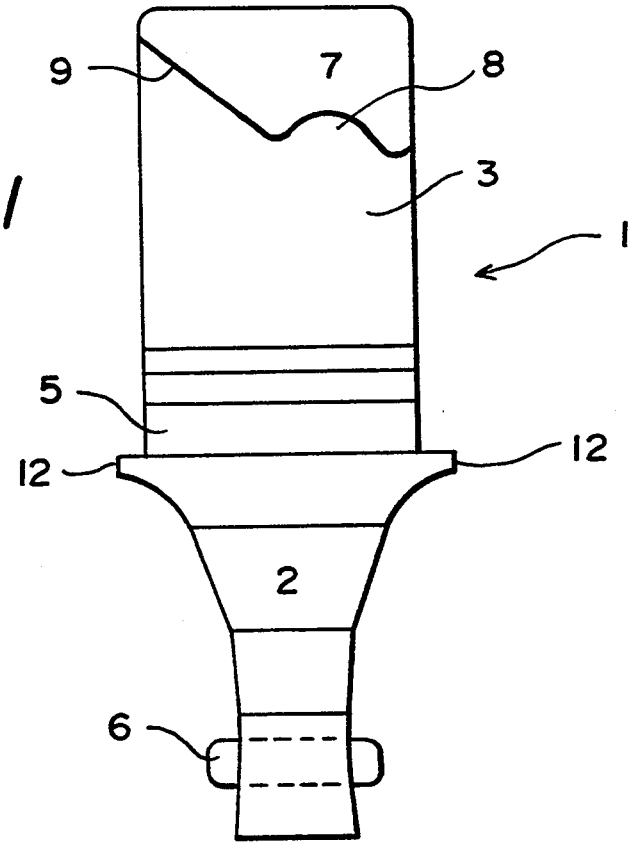
FIG. 1 shows a front view of the insert of the present invention.
Figure 2:
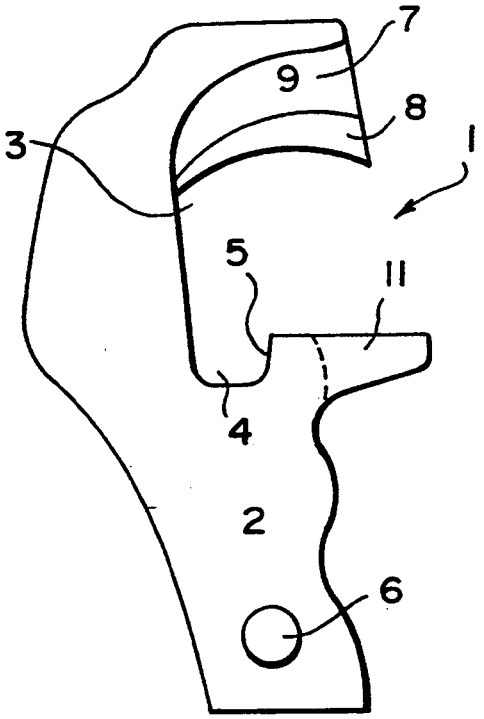
FIG. 2 shows an end view of the insert in accordance with one embodiment of this invention.

Referring to the drawings, and with particular reference to FIGS. 1 and 2, the insert 1 comprises a shank portion 2 and a jaw member 3. Jaw member 3 has a seat 4 in the form of a channel to accommodate the horizontal arm of a resilient clip (not shown). Seat 4 extends upwardly into a ledge 5. Shank 2 has a pair of pins or lugs 6 extending outwardly in opposite directions, and which provides an anchoring means between the sleeper and insert 1. When insert 1 is used with a concrete sleeper, shank 2 is disposed within the concrete sleeper. The upper surface 7 of jaw member 3 has a locating recess 8 for accommodating one of the arms of the longer loop of a resilient clip. Locating recess 8 extends into a guide means comprising an outwardly extending inclined arcuate or flat surface 9.

Such features of an insert are known in the art and do not form a concept of the present invention. In accordance with the known art, locating recess 8 had only a negligible depth and did not extend along the entire upper surface 7. Thus, the resilient clip could be removed in an unauthorized manner. To obviate such a disadvantage, recess 8 extends along the entire length of upper surface 7. Further, recess 8 has a depth of between 1/5 to ¼ of the diameter of the resilient clip so that the arm of the loop of the clip is substantially disposed within the recess. Thus, when the resilient clip is held between the bottom rail flange and insert, it cannot now be removed in an unauthorized manner.

In accordance with this invention, the arcuate or flat inclined surface 9 is no longer inclined sharply in the upward direction. Thus, in an operative position, arcuate or flat surface 9 bears against an arm of the smaller loop of the resilient clip and thereby exerts a vertical load. The inclination of the inclined surface is at an angle of 30° to 40°. Such a construction of arcuate or inclined surface 9 prevents an angular displacement of the clip.

The insert of FIG. 1 and 2 is intended for use with a resilient clip having a longer and smaller loop. The smaller loop abuts against the bottom flange of the rail and so as to take the lateral forces and keeps the gauge in correct position. The longer loop rests on top of the bottom flange and takes the vertical loads and vibrations. In accordance with this invention, ledge 5 has an abutment or projection 11 which in use is disposed away from the bottom flange. However, in the event of derailment on non functioning of the resilient clip, the rail tends to have a lateral displacement and then abuts against abutment 11 and prevents an angular displacement of the rail. Further, a pair of opposite projecting ledges 12 is provided with main ledge 5. Ledge 12 prevents any direct loading of vibrations from the clip to the sleeper in addition to casting of sleeper with proper orientation of insert in the moulds of concrete sleeper.

Figure 3:
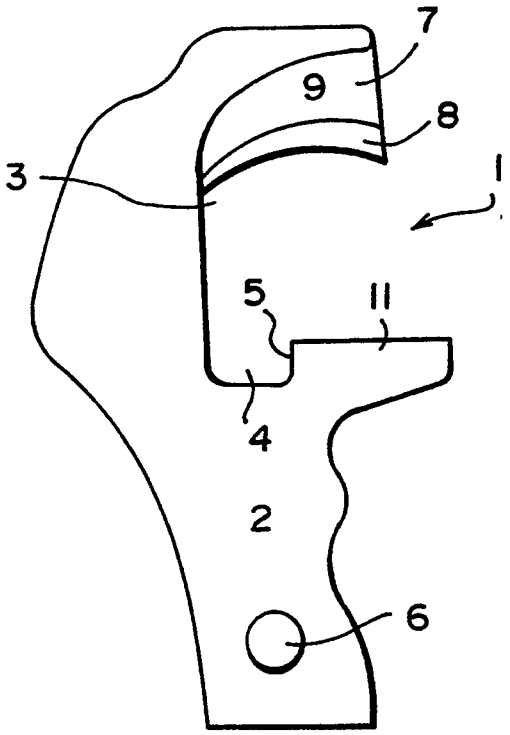
FIG. 3 shows an end view of the insert in accordance with another embodiment.

The insert of FIG. 3 is identical to that of FIGS. 1 and 2, except that the insert is for use with a clip of equal loops and, wherein, each loop bears on the upper flange. In such a construction, the abutment 11 extends across the entire length of the ledge. In use abutment 11 bears against the bottom rail flange.

Figure 5:
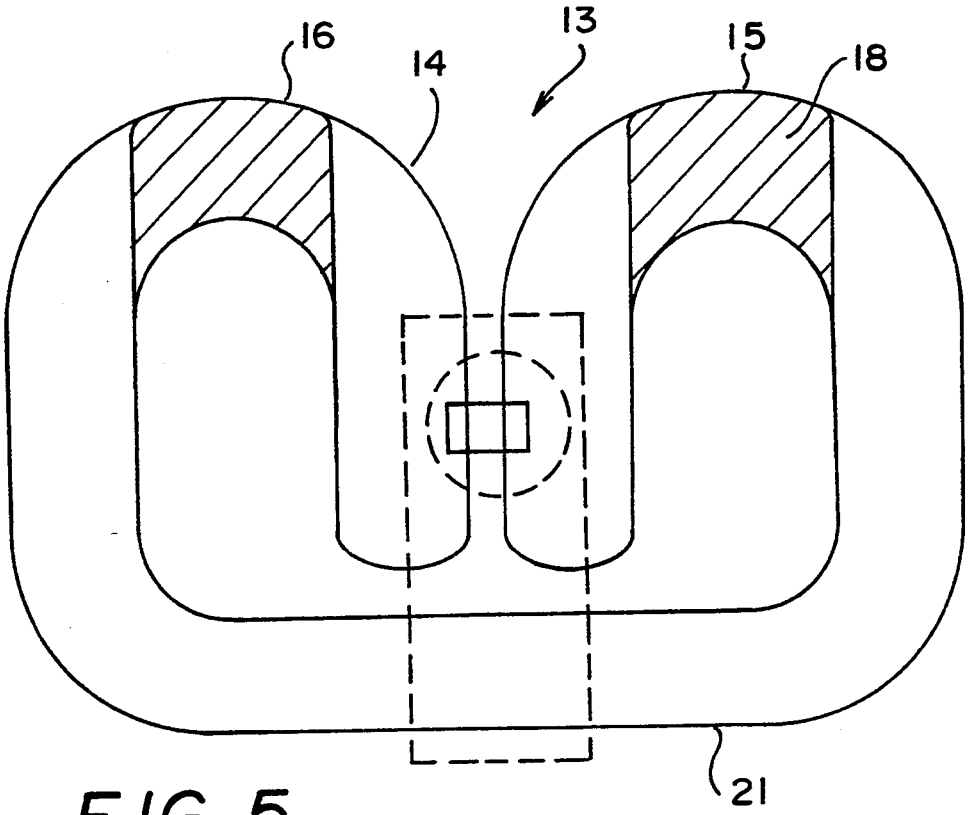
FIGS. 5 & 5A show the clip in accordance with another embodiment of this invention.

The clip 13 of the present invention and as illustrated in FIGS. 4 to 5 generally consists of two loops 14 and 15 connected to each other through a horizontal arm 21. Clip 13 is made of a spring metal bar and comprises a preformed member and may be held to a sleeper through an insert or a clamp and screw assembly. As shown in the drawings, each of loops 14 and 15 is spaced from each other. However, in the instance of a clamp and screw assembly, the spacing between loops 14 and 15 is greater than in the instance of an insert.

Reference is made to FIGS. 4 and 4A which illustrate a construction of a clip 13 having loop 14 different from loop 15. Loop 14 is a big loop and adapted to bear on the lower flange of the rail and for transferring of the vertical load vibrations to the sleeper. Loop 15 is a small loop and adapted to bear against or disposed in the immediate proximity of the lower flange of the rail for transferring of the lateral load coming on the rail. Loop 15 is intended to prevent a lateral displacement of the rail. In accordance with the present invention, loop 14 has a flat toe 16 on the under surface or that surface adapted to bear on the lower rail flange or the liner provided between the lower rail flange and loop 14. Similarly loop 15 in FIG. 4 has flat surface 20 which bears against bottom flange laterally. Several distinct advantages are provided with such a flat toe 16 as illustrated in FIG. 4 and 5. One such advantage is that the load is no longer concentrated, as known from the known construction, but uniformly distributed. Yet another distinct advantage is that there is a less concentration of stresses. A further advantage is that flat toe 16 bears against the liner with a uniform force and avoids breakage of the liner. As shown in FIG. 4A loop 14 has a raised portion 17 which provides a wedging action against longitudinal movements of the rail, which resist the forces caused due to temperature variations and dynamic movement of the rail.

Figure 5A:
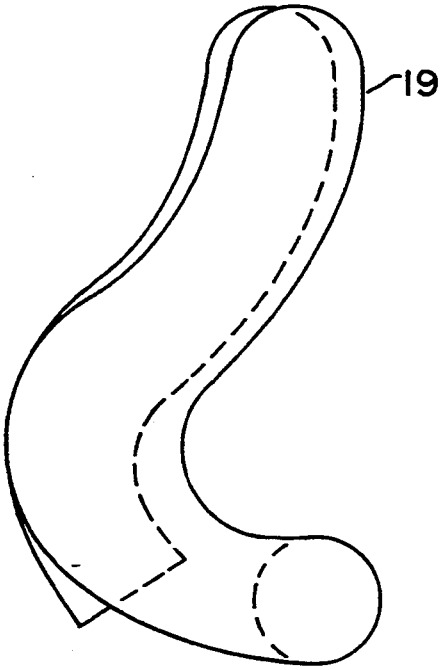

The clip of FIGS. 5 and 5A is substantially identical to that of FIGS. 4 and 4A except that in FIGS. 5 and 5A loop 15 is identical to loop 14. Loop 15 has similarly a flat toe 18 and a raised portion 19. Loop 15 also bears on the lower flange of the rail similar to loop 14.

Figure 6:
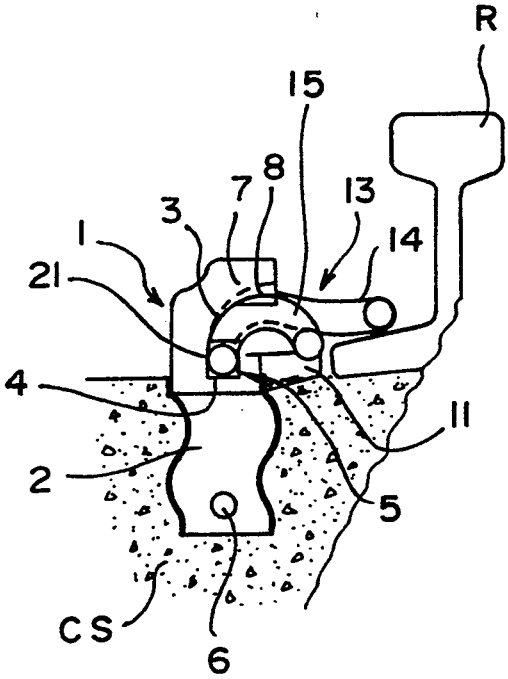
FIG. 6 shows a cross sectional view of the clip and insert of the present invention together with a tie and a rail with portions broken away.

FIG. 6 shows the insert 1 mounted in the illustrated concrete tie or sleeper CS and using a clip 13 to hold a rail R in place in the manner discussed above. As previously noted in the separate discussions of the insert and the clip, loop 15 is disposed with the recess 8 and extends down to bear laterally against the lower flange of the rail R, whereas loop 14 would be disposed against portion 9 (refer back to FIG. 2, not separately labeled in FIG. 6) and extends to bear on the top of the bottom flange of the rail R.

I claim:

1. A rail fastening assembly comprising an insert and a resilient clip, said insert comprising a shank portion extending into a jaw, the base of said jaw having a seat in the form of channel, the upper surfaces of said jaw having a locating recess extending into an inclined flat surface, the locating recess extending along the entire length of the upper surface of the jaw and has a depth for accomodating the resilient clip, said seat having a ledge extending into a projection, said projection extending beyond said jaw.

2. An assembly as claimed in claim 1 wherein said projection is provided along a part of the length of the ledge.

3. An assembly as claimed in claim 1 wherein said projection is provided along the entire length of the ledge.

4. An assembly as claimed in claim 1 wherein the location recess has a depth of 1/5th to ¼th of the diameter of the resilient clip.

5. An assembly as claimed in claim 1 wherein said inclined surface is provided at an angle of 30° to 40° relative to a horizontal axis.

6. An assembly as claimed in claim 1 wherein said clip comprises a first loop having a raised surface adapted to bear on a rail flange for dampening of vertical vibrations and loads, said first loop extending into a second loop, said second loop having a flat surface so as to bear against a bottom portion of said flange of said rail, means for securing said clip within said insert, said first loop having a flat portion to bear on the rail flange for distribution of the load and to reduce the stress concentration.

7. An assembly as claimed in claim 6 wherein, the second loop having a flat surface which bears against the bottom flange laterally is smaller than said first loop.

8. An assembly as claimed in claim 6 wherein said second loop is identical to said first loop.

9. An assembly as claimed in claim 8 wherein said second loop has a raised portion.

10. A rail fastening assembly comprising an insert and a resilient clip, said insert comprising a shank portion extending into a jaw, the base of said jaw having a seat in the form of channel, the upper surfaces of said jaw having a locating recess extending into an arcuate surface, the locating recess extending along the entire length of the upper surface of the jaw and has a depth for accommodating the resilient clip, said seat having a ledge extending into a projection, said projection extending beyond said jaw.

11. An assembly as claimed in claim 10 wherein said projection is provided along a part of the length of the ledge.

12. An assembly as claimed in claim 10 wherein said projection is provided along the entire length of the ledge.

13. An assembly as claimed in claim 10 wherein the locating recess has a depth of 1/5th to ¼th of the diameter of the resilient clip.

* * * * *